US005437167A

United States Patent [19]

Ambar

[11] Patent Number: 5,437,167

[45] Date of Patent: Aug. 1, 1995

[54] INVISIBLE SETTING FOR ROUND DIAMOND STONE

[76] Inventor: Betzalel Ambar, 4359 Ponca Ave., Los Angeles, Calif. 91602

[21] Appl. No.: 241,596

[22] Filed: May 12, 1994

[51] Int. Cl.[6] ..... A44C 17/02; A44C 17/00

[52] U.S. Cl. ..... 63/26; 63/32

[58] Field of Search ..... 43/26, 28, 32

[56] References Cited

U.S. PATENT DOCUMENTS

| | | | |
|---|---|---|---|
| 2,069,598 | 2/1937 | Arpels | 63/27 |
| 2,141,363 | 12/1938 | Rigollet | 63/26 |
| 3,286,486 | 11/1966 | Huisman et al. | 63/32 |
| 3,585,764 | 6/1971 | Huisman | 63/32 |
| 3,808,836 | 5/1974 | Jones | 63/32 |
| 3,875,760 | 4/1975 | Jones | 63/32 |
| 4,748,728 | 6/1988 | Maghien et al. | 63/28 |
| 4,800,738 | 1/1989 | Bunz | 63/26 |
| 5,115,649 | 5/1992 | Amber | 63/32 |
| 5,123,265 | 6/1992 | Ramot | 63/32 |
| 5,186,024 | 2/1993 | Waters, Jr. | 63/32 |

*Primary Examiner*—Michael J. Milano

*Attorney, Agent, or Firm*—Levisohn, Lerner, Berger & Langsam

[57] ABSTRACT

A method and apparatus for invisibly setting round precious stones, particularly diamonds, is disclosed. The stones are provided with grooves cut in a belt portion, which is a faceted portion located between the girdle and the pavilion. The setting is a cylindrical barrel which is provided with wedge-shaped tongues projecting inwardly from the wall of the barrel. The outside of the barrel is hammered such that under the hammering force the elasticity of the metal permits the advance of the tongues into the grooves. The barrel forms a secure setting for the stone. Each of the wedges which are opposite form an obtuse downward angle which prevents the loosening of the stones, in the upward direction, such that the stone does not become free from the setting.

6 Claims, 1 Drawing Sheet

FIG. 1
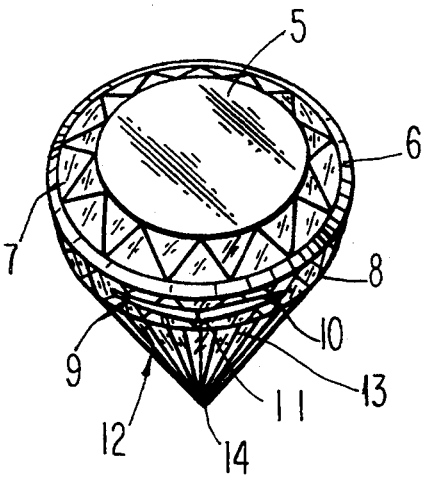
FIG. 2
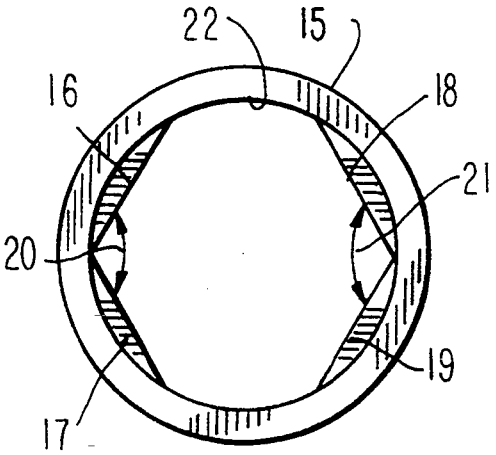
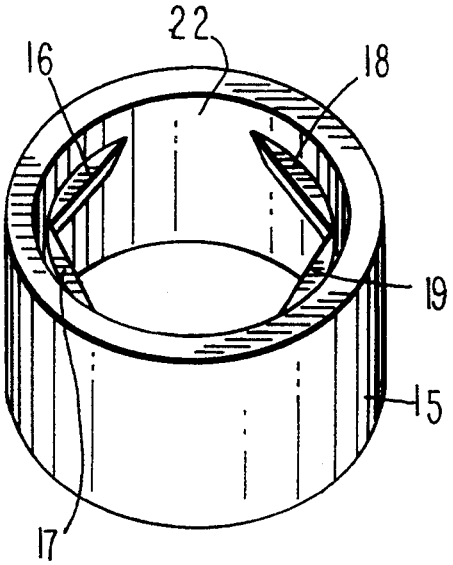
FIG. 3
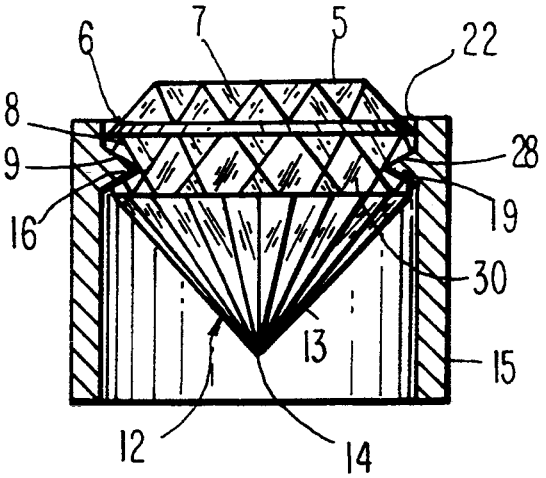
FIG. 4
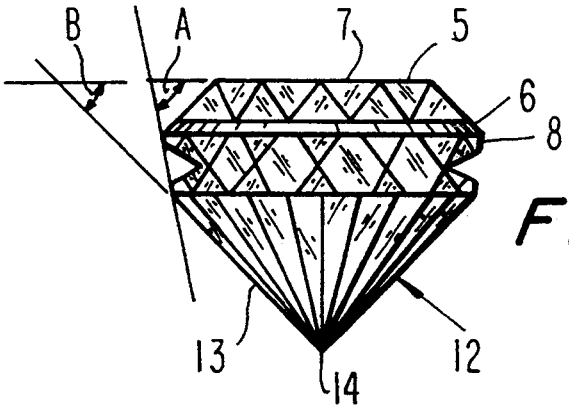
FIG. 5

INVISIBLE SETTING FOR ROUND DIAMOND STONE

BACKGROUND OF INVENTION

This invention relates to a method and apparatus for securing round diamonds of high quality in a setting which is in hidden from view.

The prior art has included invisible settings for round diamonds that are identified, for example, in U.S. Pat. No. 5,072,601 held by the assignee of the present invention. This invisible setting is illustrative of a technique in which a groove beneath the girdle is cut into the round stone at a depth which provides securing means for the setting to maintain the stone in place.

In U.S. patent '601, a continuous thread-like groove is cut partially around the circumference of the conical shaped pavilion such that the stone can be twisted into position in the setting member. However, a stone held in such a setting, over time, can become loose and twist out of the setting. To avoid such problems, an improvement would require a groove with a deeper radius and with a larger pitch. However, the surface and length of the pavilion does not permit such modifications without imparting diminished reflection in the stone.

An object of this invention is to provide such a method and apparatus for invisibly setting round precious stones so as to enhance the overall visual appearance.

Another object of this invention is to provide such a method and apparatus which enhances and maintains the reflective properties of the stone in an invisible setting.

Another object of this invention is to provide such a method and apparatus which is easy to practice and which utilizes the elastic properties of the material to secure the stone without damage.

Yet another object of this invention is to provide such a method and apparatus in which the stone is set securely, particularly over the duration of time the setting is worn by an individual.

Other objects, advantages and features of this invention will be more apparent from the following description.

SUMMARY OF THE INVENTION

In accordance with the principles of this invention the above objects are accomplished by providing a cut for a precious stone, particularly diamonds, and a setting which forms an invisible setting method to avoid the above disadvantages of the prior art.

The present invention, with the new belt portion, provides a surface so that the groove is located furthest from the center of the stone as compared with prior round invisibly set diamonds. The belt provides a uniform surface for the cutting of grooves to avoid their placement along a non-uniform, inward sloping, surface of the pavilion.

The grooves are cut into the stone at an angle and a depth such that the tongue of the barrel will form a secure means to hold the position of the stone. A force applied to the tongue permits the material to intrude into the groove of the stone. The elasticity of the material provides a means for the advancement of the groove to securely hold the stone. Though the setting protrudes into the stone and may lessen some of the reflective properties, the belt contains additional facets to help minimize any diminishment. Moreover, the tongues are positioned, in opposite pairs, in which each pair forms an obtuse angle. The angle opens, relative to the table of the stone, in the downward direction which further permits the security of the stone. The forces of the tongue act in the downward direction and prevent the upward movement and slippage of the stone which could result in the loosening of the stone from the setting.

The setting of the present invention is invisible because the stone is secured into the setting by a barrel. The barrel has tongues located in the inner wall. The tongues fit securely into the groove in the belt portion of the stone. The belt portion of the stone is located directly below the girdle. The invisible setting is achieved because the grooves are at a height which secure the stone in the barrel such that the top edge of the barrel is juxtaposed at the top of the girdle of the stone. Moreover, the depth of the intrusion of the tongue is not so large that it is noticeable in the overall appearance of the jewelry piece. Rather, the tongues in the belt hold the stone securely in place by forming obtuse downward angles.

BRIEF DESCRIPTION OF THE DRAWINGS

The invention will be described in more detail hereinafter with reference to the accompanying drawings, in which:

FIG. 1 illustrates the stone with the grooves located in the belt;

FIG. 2 is a top view of the barrel provided with the tongue portion;

FIG. 3 is a perspective view of the barrel illustrating the angle of the guide grooves as positioned in the inner wall of the barrel.

FIG. 4 is a side view illustrating the position of the tongues into the grooves of the round stone.

FIG. 5 is a side view similar to FIG. 4 showing only the diamond.

DETAILED DESCRIPTION

FIG. 1 illustrates a round diamond 12 in which there is a table 5, a girdle 6 and a faceted portion 7 therebetween. There is a multi-faceted belt portion 8 located below the girdle 6. Belt 8 has an outer circumference which extends to a pavilion 13. The belt 8 has grooves 9 and 10 with a cut at a downward angle 11. The grooves are cut in the outer surface and are positioned at preferably the same level in the belt 8 of the stone 12. Below the belt is the pavilion 13 of the stone 12 which terminates at a cullet 14.

FIG. 2 illustrates a barrel 15 in which there are four tongues 16, 17, 18 and 19 projecting inwardly from inner wall 22 of barrel 15. Pairs of the tongues 16 and 17, and 18 and 19, form obtuse angles 20 and 21, respectively. Angles 20 and 21 are opposite to each other. The barrel 15 is comprised of a round, cylindrical structure having a circumference which is slightly smaller than the girdle circumference of the round diamond. The barrel 15 is preferably composed of an elastic metal, such as gold, so that its deformation permits the advancement of the tongues 16, 17, 18 and 19 into the respective grooves of the stone. As illustrated in FIG. 3, the tongues 16, 17, 18 and 19 are located near the top of the barrel 15 such that the they secure the stone in a position which rests slightly above the barrel 15.

In FIG. 4, the stone and barrel as well as the method of setting the stone are illustrated. The barrel 15 has wedge-shaped tongues 20 and 21 which are forced into grooves 11 and 28 located in the belt portion 8. The girdle 6 of the stone rests above the top of the barrel 15 preventing the belt 8 and barrel 15 interlock from interfering with the above faceted region 7. The facets 30 on the circumferential surface of the belt 8 further enhances the brilliance of the stone. The addition of the facets provides an additional reflecting surface in the stone.

FIG. 5 illustrates a side view showing the round stone with the table portion forming acute angles A and B with respect to belt portion 8 and pavillion portion 13, respectively. As can be seen angle A is larger than angle B, and angle A could also be 90°.

This invention has been described with reference to a preferred embodiment, and the scope and protection of the invention is as set forth in the claims.

I claim:

1. Apparatus for setting a precious round stone, said round stone having a top surface forming a table, said table terminating in an annular girdle, a conical pavilion portion located below said girdle terminating in a cullet at the bottom thereof, said pavilion portion forming a first acute angle with respect to said table, said round stone comprising an annular belt portion located between the girdle and pavilion, at least three coplanar groove segments formed within said belt portion and spaced circumferentially around said belt portion, said annular belt portion having an outer annular circumferential surface which forms a second angle with respect to said table, wherein the second angle is greater than said first acute angle, said setting means further comprising a cylindrical barrel within which said round stone sits, at least three tongue members integrally formed with and projecting inwardly from said cylindrical barrel, said tongue members aligning with said groove segments in said belt, wherein said cylindrical barrel is deformable and is deformed so that said tongue members move into said groove segments to hold the precious round stone in place.

2. Apparatus as set forth in claim 1, wherein said outer circumferential surface of said belt portion is perpendicular to the table.

3. Apparatus as set forth in claim 1 , wherein said outer circumferential surface forms a second acute angle, with said second acute angle being greater than said first acute angle.

4. Apparatus as set forth in claim 1, wherein said grooves are wedge-shaped.

5. Apparatus as set forth in claim 1, wherein said groove segments are formed as two sets of two grooves located opposite each other in said belt portion.

6. Apparatus as set forth in claim 5, wherein said grooves form angles which are projected in the downward direction.

* * * * *